US007610735B2

(12) United States Patent
Monti

(10) Patent No.: US 7,610,735 B2
(45) Date of Patent: Nov. 3, 2009

(54) MACHINE FOR PACKING STACKS OF DISC-SHAPED ARTICLES INSIDE RIGID CYLINDRICAL CONTAINERS

(75) Inventor: Giuseppe Monti, Pianoro (IT)

(73) Assignee: Marchesini Group S.p.A., Pianoro (Bologna) (IT)

( * ) Notice: Subject to any disclaimer, the term of this patent is extended or adjusted under 35 U.S.C. 154(b) by 53 days.

(21) Appl. No.: 12/041,251

(22) Filed: Mar. 3, 2008

(65) Prior Publication Data

US 2008/0223003 A1 Sep. 18, 2008

(30) Foreign Application Priority Data

Mar. 14, 2007 (IT) ..... BO 2007 A 000176

(51) Int. Cl.

| | |
|---|---|
| ***B65B 57/00*** | (2006.01) |
| ***B65B 5/10*** | (2006.01) |
| ***B65B 43/46*** | (2006.01) |
| ***B65B 43/54*** | (2006.01) |
| ***B65B 7/28*** | (2006.01) |

(52) U.S. Cl. ..... 53/53; 53/244; 53/251; 53/254; 53/282; 53/300; 53/319

(58) Field of Classification Search ..... 53/53, 53/532, 244, 250, 251, 253, 254, 281, 282, 53/284.5, 299, 300, 319; *B65B 5/10, 43/46, B65B 43/54*

See application file for complete search history.

(56) References Cited

U.S. PATENT DOCUMENTS

| | | | | |
|---|---|---|---|---|
| 2,845,759 | A * | 8/1958 | Cote et al. | 53/250 |
| 2,876,604 | A * | 3/1959 | Engleson et al. | 53/244 |
| 3,028,713 | A * | 4/1962 | Kennedy et al. | 53/251 |
| 3,064,406 | A | 11/1962 | Kennedy et al. | |
| 3,129,544 | A * | 4/1964 | Klapes et al. | 53/250 |
| 3,139,713 | A | 7/1964 | Merrill et al. | |
| 3,273,300 | A * | 9/1966 | Watrous et al. | 53/250 |
| 3,590,982 | A * | 7/1971 | Banyas | 198/470.1 |
| 4,138,835 | A * | 2/1979 | Takayanagi et al. | 53/244 |
| 4,596,107 | A * | 6/1986 | Pfleger, Sr. | 53/53 |
| 4,645,060 | A | 2/1987 | Argazzi | |
| 4,930,289 | A * | 6/1990 | Fransson et al. | 53/251 |
| 2004/0104243 | A1 | 6/2004 | Osborne et al. | |
| 2005/0166547 | A1 * | 8/2005 | Monti | 53/282 |

FOREIGN PATENT DOCUMENTS

JP 2006168759 A * 6/2006

* cited by examiner

*Primary Examiner*—Stephen F Gerrity
(74) *Attorney, Agent, or Firm*—William J. Sapone; Coleman Sudol Sapone P.C.

(57) ABSTRACT

A machine for packing tablets inside rigid tubes exhibits: a supply line for supplying empty tubes arranged with vertical axes and mouths facing upwards; an inlet station wherein deflector organs operate which tip the cylindrical containers on sides thereof, and first organs which pick up individual thus-tipped containers and release the containers to corresponding gripping organs provided by a multiple conveyor; a filling station in which a plurality of supply units release a predetermined quantity of tablets, stacked one on the other, into paused tubes, borne by the multiple conveyor; a closing station containing devices which insert caps into the mouths of the filled containers borne by the multiple conveyor; an outlet station containing devices which pick up paused individual closed containers borne by the multiple conveyor and release the containers onto transporter organs.

22 Claims, 14 Drawing Sheets

MACHINE FOR PACKING STACKS OF DISC-SHAPED ARTICLES INSIDE RIGID CYLINDRICAL CONTAINERS

BACKGROUND OF THE INVENTION

The invention concerns the technical sector of machines for packing articles, with particular reference to machines for packing stacks of disc-shaped articles, in particular tablets, in rigid cylindrical containers, especially tubes.

The prior art includes machines for filling and subsequently capping vertically arranged, rigid cylindrical containers of a tubular shape.

In these machines, containers coming from a supply line are loaded one by one onto a conveyor to be transferred firstly to a filling station and then, possibly through other intermediate stations, to a capping station, and finally to an outlet station.

At the filling station, a plurality of articles are inserted into the tubular containers, one-by-one and stacked one on the other.

This filling operation must necessarily be performed with the container at rest, the duration of the operation depending on the time required for a single insertion and on the number of insertions necessary to fill the container.

The other operations, performed in the stations upstream and downstream of the filling station, are carried out to coincide with the rest stage for the filling operation, even though the times required for these operations are inferior to the time required for filling.

In a first type machine, a single step conveyor can be used to advance the containers, while the rest period required between each advancement step must be calibrated on the basis of the time required for the longest lasting operation, that is, the filling operation.

A technical solution of this kind provides an extremely slow machine with unsatisfactory productivity.

A second type of machine has multiple operating organs in each station, acting at the same time upon a plurality of containers, with a conveyor activated with a multiple step corresponding to the number of containers handled at each stage.

In this way, a proportional increase in productivity is obtained in comparison with the first type of machine, with the same duration of the rest stage, but considerable constructional complications arise concerning the machine's operating organs: the greater the number of containers to be dealt with simultaneously, the more numerous these complications become.

A machine of this type provides reasonable, but not optimum productivity compared with market standards, and presents significant negative aspects both in terms of costs and operational reliability.

SUMMARY OF THE INVENTION

An aim of this invention is to obviate the abovementioned drawbacks by providing a machine for packing stacks of disc-shaped articles, tablets in particular, inside rigid cylindrical containers, tubes in particular, which adapts the advancement cycle of the containers to the optimum conditions for each operating station of the machine, in such a way as to ensure high productivity while at the same time achieving the greatest simplicity of construction for the operating organs situated at each station.

A further aim of the invention is to provide a machine which has a limited cost and is particularly reliable and versatile under all operating conditions.

A still further aim is to provide a machine with an extremely compact layout configuration and extremely limited bulk.

The above-mentioned aims are achieved by means of a machine for packing stacks of disc-shaped articles in rigid cylindrical containers, wherein it comprises: a line which supplies empty cylindrical containers to an inlet station containing organs which release the empty containers, arranged with axes vertical and with mouths facing upwards, to corresponding gripping organs provided on a multiple conveyor; a filling station, provided downstream of the inlet station, which contains a plurality of supply units which release a predetermined quantity of stacked disc-shaped articles into a plurality of cylindrical containers in a paused state, which plurality of cylindrical containers are borne by the multiple conveyor; a closing station, located downstream of the filling station, containing means which pick up caps coming from a supply line and insert the caps into the mouths of the filled containers borne by the multiple conveyor, thus closing the containers; an outlet station, provided downstream of the closing station, containing second organs which pick up paused individual closed containers borne by the multiple conveyor and release the containers to transporter organs; and further wherein the multiple conveyor comprises: at least an upper transporter and a lower transporter, which extend one above the other along a same ring-wound trajectory, to each of which at least two batteries of gripping organs are associated, at a same distance from one another, the at least two batteries associated to the upper transporter being intercalated with the corresponding at least two batteries associated to the lower transporter, defining a number of empty places between the at least two consecutive batteries of the upper transporter and of the lower transporter, which number of empty places is dynamically variable from zero to a maximum value; motor organs which independently activate the upper transporter and the lower transporter, resulting in an uninterrupted and intermittent presence of gripping organs at the inlet station, and of gripping organs associated to a relative container at the closing station and the outlet station and resulting in keeping the battery situated immediately downstream of the inlet station paused in the filling station, such as to avoid interference between the containers paused in the filling station and the empty containers associated to the gripping organs situated upstream of the filling station, which empty containers are intermittently-activated.

BRIEF DESCRIPTION OF THE DRAWINGS

The characteristics of the invention are highlighted below in a description of several preferred but non-exclusive embodiments, with reference to the appended figures of the drawings in which.

DESCRIPTION OF THE PREFERRED EMBODIMENTS

Figure 1:
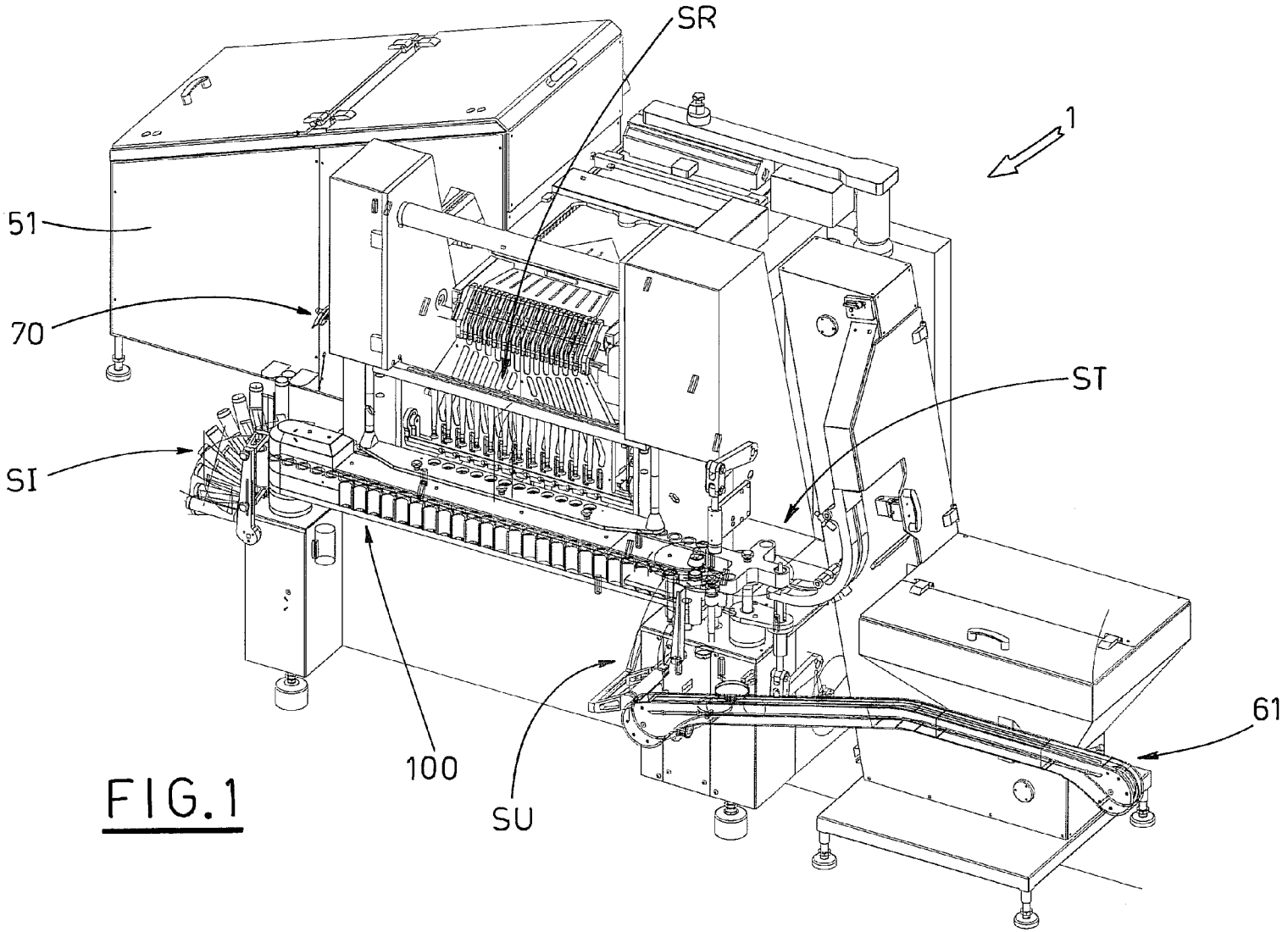
FIGS. 1, 2 schematically illustrate a perspective view and a plan view of the machine of the invention.

In the tables the reference number 1 indicates the machine of the invention for packing stacks of disc-shaped articles 2, tablets in particular, inside rigid cylindrical containers 4, for example tubes, comprising:

- a supply line 70 supplying empty cylindrical tubes 4 arranged with vertical axes and with mouths 4*a* facing upwards;
- an inlet station SI, situated downstream of the supply line 70, in which deflector organs 71 operate which enable the cylindrical containers 4 to be tilted sideways so that the axes thereof are preferably horizontally oriented, and first organs 72, which pick up individual containers 4 tipped on their side and release them, with the axes thereof vertical and mouths 4*a* facing upwards, to corresponding gripping organs 3 provided by a multiple conveyor 100;
- downstream of the inlet station SI, a filling station SR in which a plurality of supply units 90 operate, releasing a predetermined quantity of tablets 2, stacked one upon the other, into a plurality of cylindrical tubes 4 at rest, borne by the multiple conveyor 100;
- downstream of the filling station SR, a closing station ST in which means operate which pick up caps 5 coming from a supply line 50 and insert the caps 5 into the mouths 4*a* of the filled containers 4 borne by the multiple conveyor 100, thus closing the filled containers 4;
- downstream of the closing station ST an outlet station SU in which second organs 74 operate, picking up individual capped tubes 4 at rest, borne by the multiple conveyor 100, and releasing the capped tubes 4, for example tipped on their side with horizontal axes, at adjacent transporter organs 61.

Figure 17:
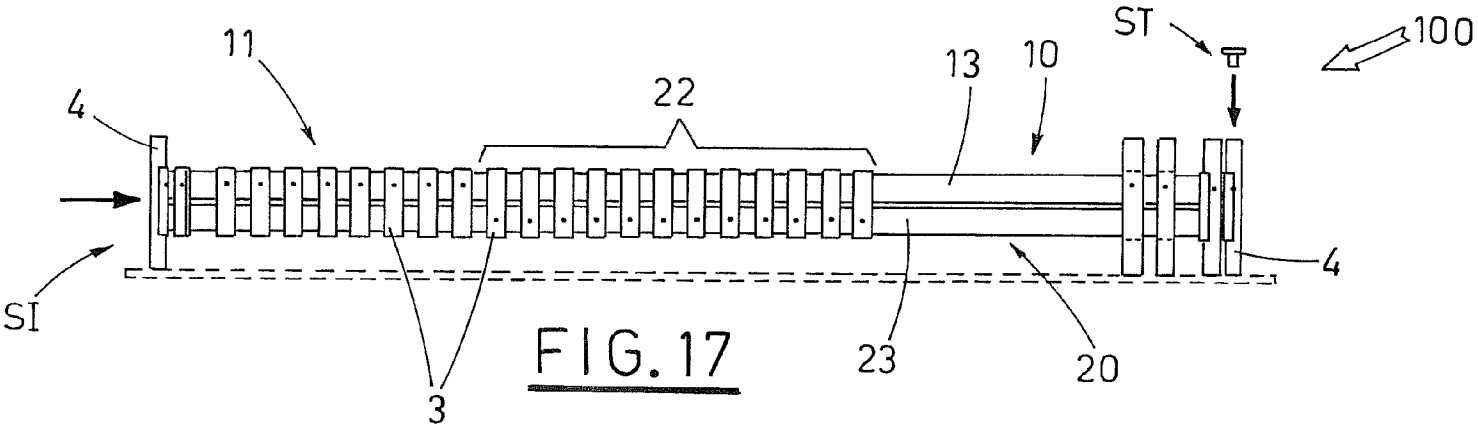
FIG. 17 schematically shows a side view of a multiple conveyor operating in the machine.
Figure 18A:
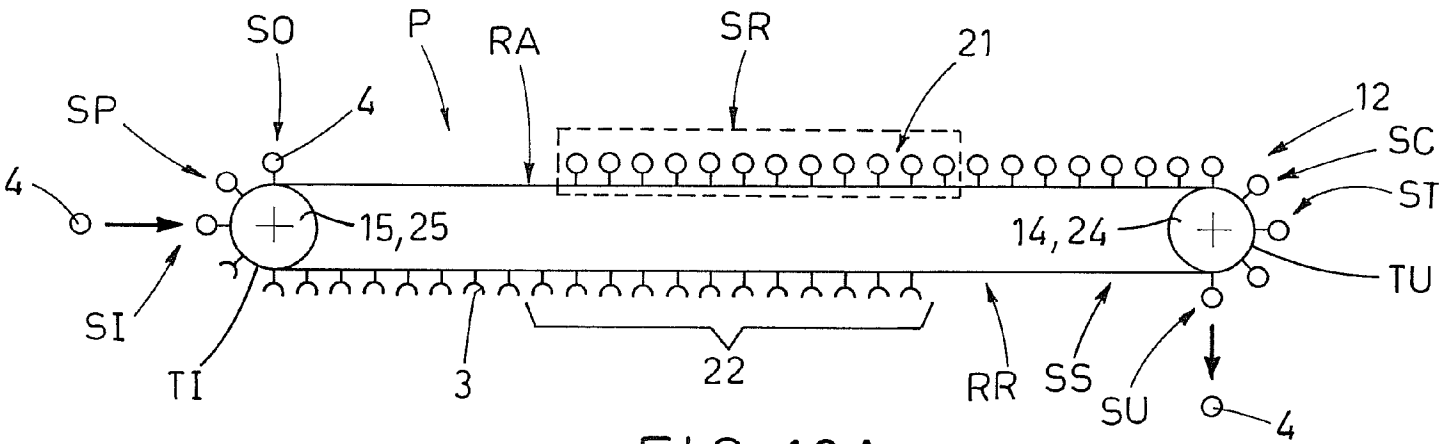
FIG. 18A, 18B, 18C schematically show three plan views of the conveyor shown in FIG. 17 in successive operating stages.
Figure 18B:
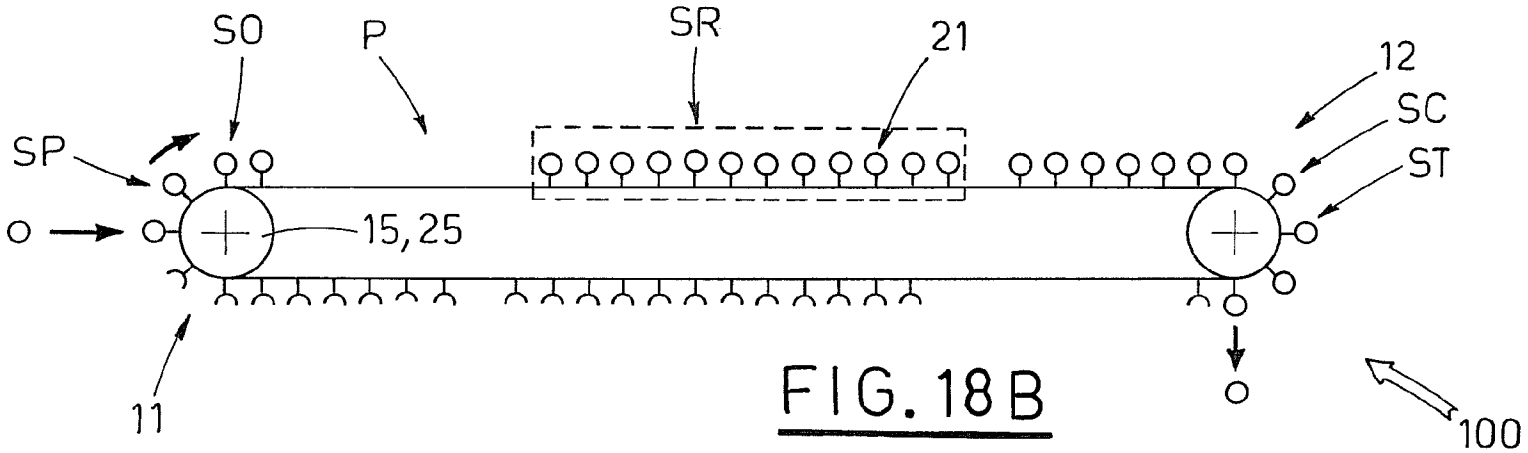
Figure 18C:
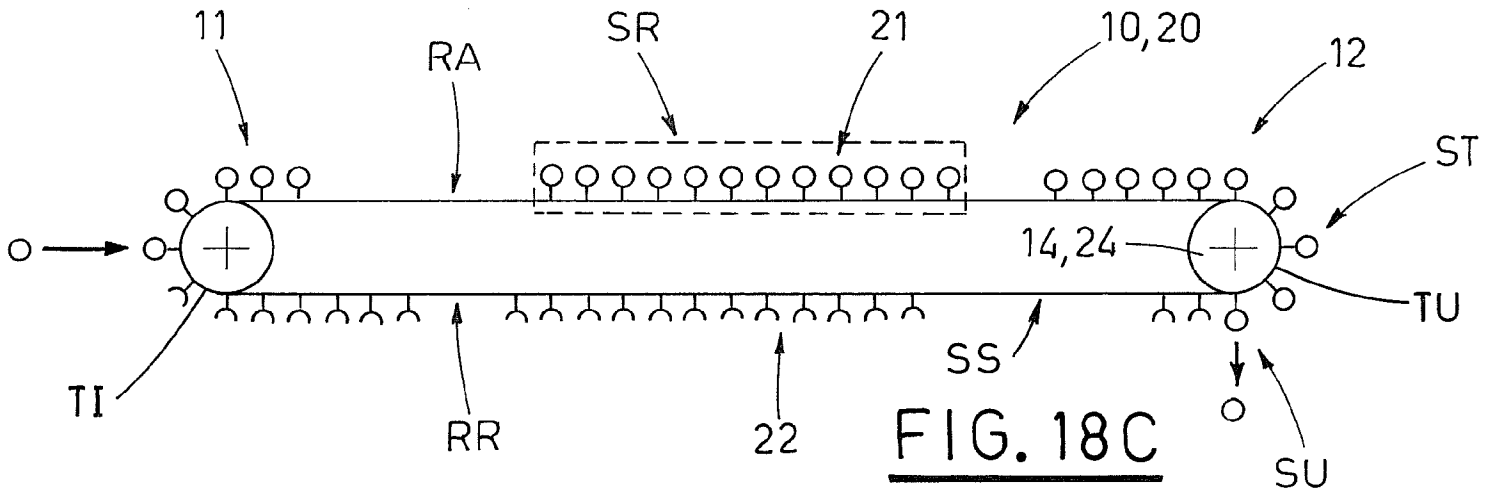

According to an advantageous feature of the machine 1 of the invention, in accordance with the application for Italian patent BO2007A000085, the multiple conveyor 100 comprises an upper transporter 10 and a lower transporter 20, which extend along ring-wound trajectories P one above the other, and at least two equidistant batteries 11,12; 21, 22 of gripping organs 3 are constrained to each transporter 10, 20, as shown in FIGS. 17 and 18.

The batteries 11, 12 associated to the upper transporter 10 are intercalated with corresponding batteries 21, 22 associated to the lower transporter 20, thus defining a number of empty places, dynamically variable from zero to a maximum number, between two consecutive batteries of the upper transporter 10 and the lower transporter 20.

The conveyor 100 also has motor organs to activate the upper transporter 10 and the lower transporter 20 independently, resulting in the intermittent and uninterrupted presence of gripping organs 3 at the inlet station SI and of gripping organs 3 associated to a relative container 4 both at the closing station ST and at the outlet station SU; moreover, the battery situated immediately downstream of the inlet station SI is maintained at rest at the filling station SR, in such a way as to avoid interference between the containers 4 at rest at the filling station SR and the empty containers 4 associated to the intermittently activated gripping organs 3 situated upstream of the filling station SR.

The motor organs of each transporter 10, 20 advantageously have an electronically controlled motor, preferably of the brushless type, which activates the corresponding transmission organs, which consist of a flexible organ 13, 23, for example a cogged belt, to which the batteries 11, 12; 21, 22 of gripping organs 3 are associated and which is ring-wound on two pulleys, a drive pulley 14, 24 and a driven pulley 15, 25.

It is apparent from FIGS. 17, 18A, 18B, 18C, the respective drive pulleys 14, 24 and driven pulleys 15, 25 of the upper transporter 10, and the lower transporter 20, are arranged coaxially to each other, in such a way that the two cogged belts 13, 23 are one above the other and the shared ring-wound trajectory P has a straight outgoing advancement branch RA and a straight return advancement branch RR, connected near the pulleys 14, 15; 15, 25 by an inlet curved section TI and an outlet curved section TU.

In a preferred layout configuration of the machine 1, the inlet station SI is positioned in the inlet curved section TI, the filling station SR is arranged along the outgoing advancement branch RA, the closing station ST is located in the outlet curved section, and the outlet station SU is interposed between the end section of the outlet curved section and the initial section of the return advancement branch RR.

Similarly the supply line 70 of empty tubes 4 is arranged perpendicular to the branches RA, RR of the multiple conveyor 100, and the transporter organs 61 which cooperate with the outlet station SU are arranged parallel to the branches RA, RR of the multiple conveyor 100.

Figures 3A, 3B, 4, 5, 6:
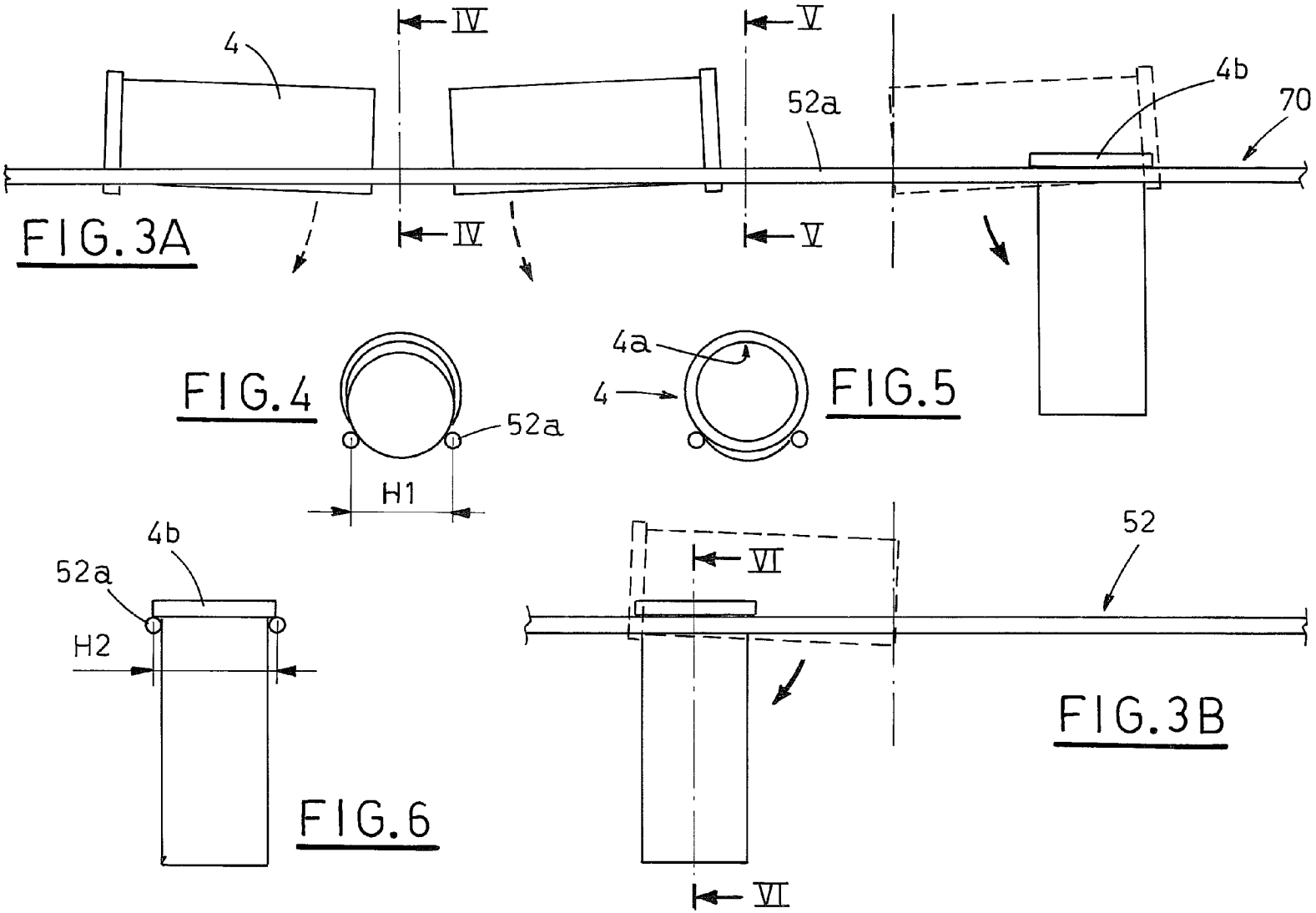
FIGS. 3A, 3B schematically represent enlarged, corresponding side views of empty containers in successive transfer operating stages.
FIGS. 4, 5, 6 each show a view respectively along the sections IV-IV, V-V, VI-VI shown in FIGS. 3A, 3B.

With special reference to FIGS. 3A, 3B, the supply line 70 receives empty tubes 4 with random horizontal orientation released from a magazine 51 and directs them by means of a conveyor 52 towards deflector organs 71 operating at the inlet station SI.

The conveyor 52 consists of a pair of wire-shaped elements 52*a* which identify a first and a second region, on the basis of the reciprocal distance between the wire-shaped elements 52*a*.

In the first region, immediately downstream of the magazine 51, the wire-shaped elements 52*a* are distanced by a value H1 which is smaller than the diameter of the cylindrical body of the tubes 4, such as to enable the tubes 4 to be conveyed with their axes horizontal (FIGS. 3A, 4, 5).

In the second region, immediately upstream of the inlet station SI, the wire-shaped elements 52*a* are distanced by a value H2>H1 greater than the diameter of the cylindrical body of the tubes 4, but not greater than the diameter of the collar of the top 4*b* of the tubes 4, in such a way as to enable the tubes 4 to be tipped, with their axes oriented vertically, the tubes 4 being retained between the wire-shaped elements 52*a* at the tops 4*b* thereof (FIG. 3A, 3B, 6).

Figure 2:
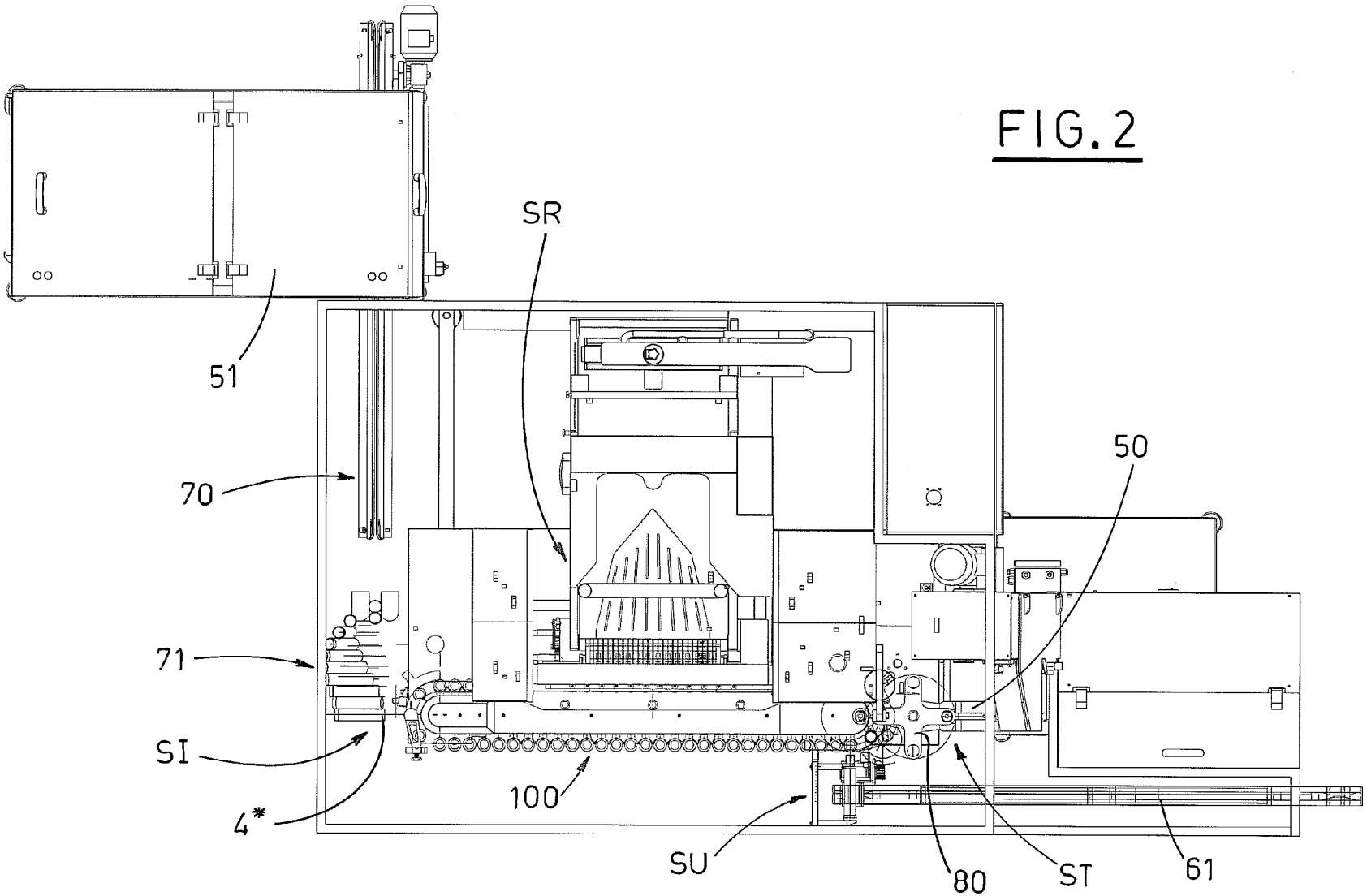
Figure 7:
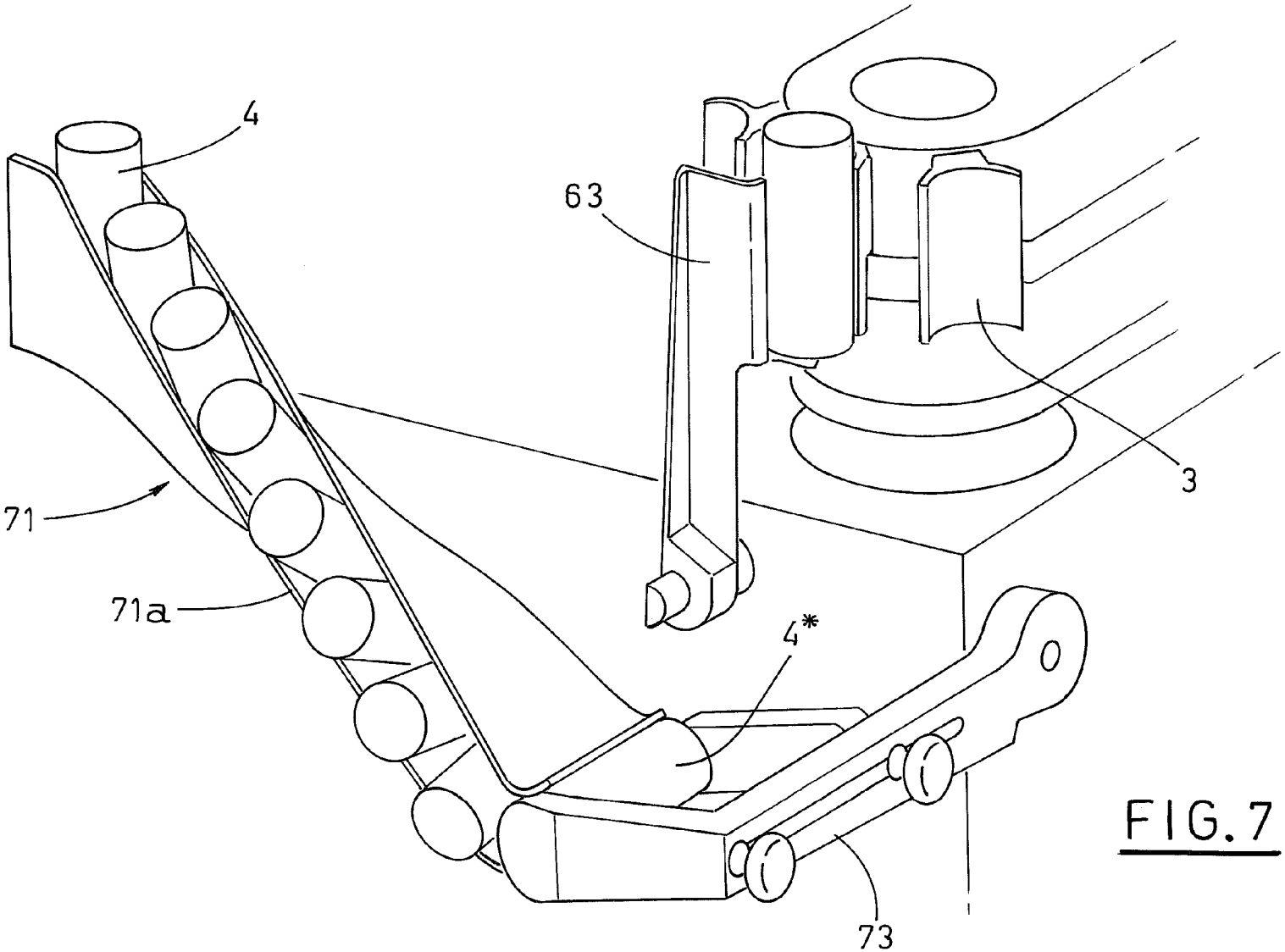
FIG. 7 schematically illustrates, in enlarged scale with respect to FIGS. 1, 2, a perspective view of a particularly significant interface station.

With particular reference to FIGS. 1, 2 and 7, the deflector organs 71 operating in the inlet station SI comprise a sloping channel 71*a*, provided with a bottom and a pair of opposite-facing walls, capable of overturning the empty tubes 4 in a guided manner.

The end section of the channel 71 a is situated lower than the initial section and cooperates with abutment means 62 of the leading tube 4* of the row of containers 4 contained within the channel (FIG. 7).

Figure 8:
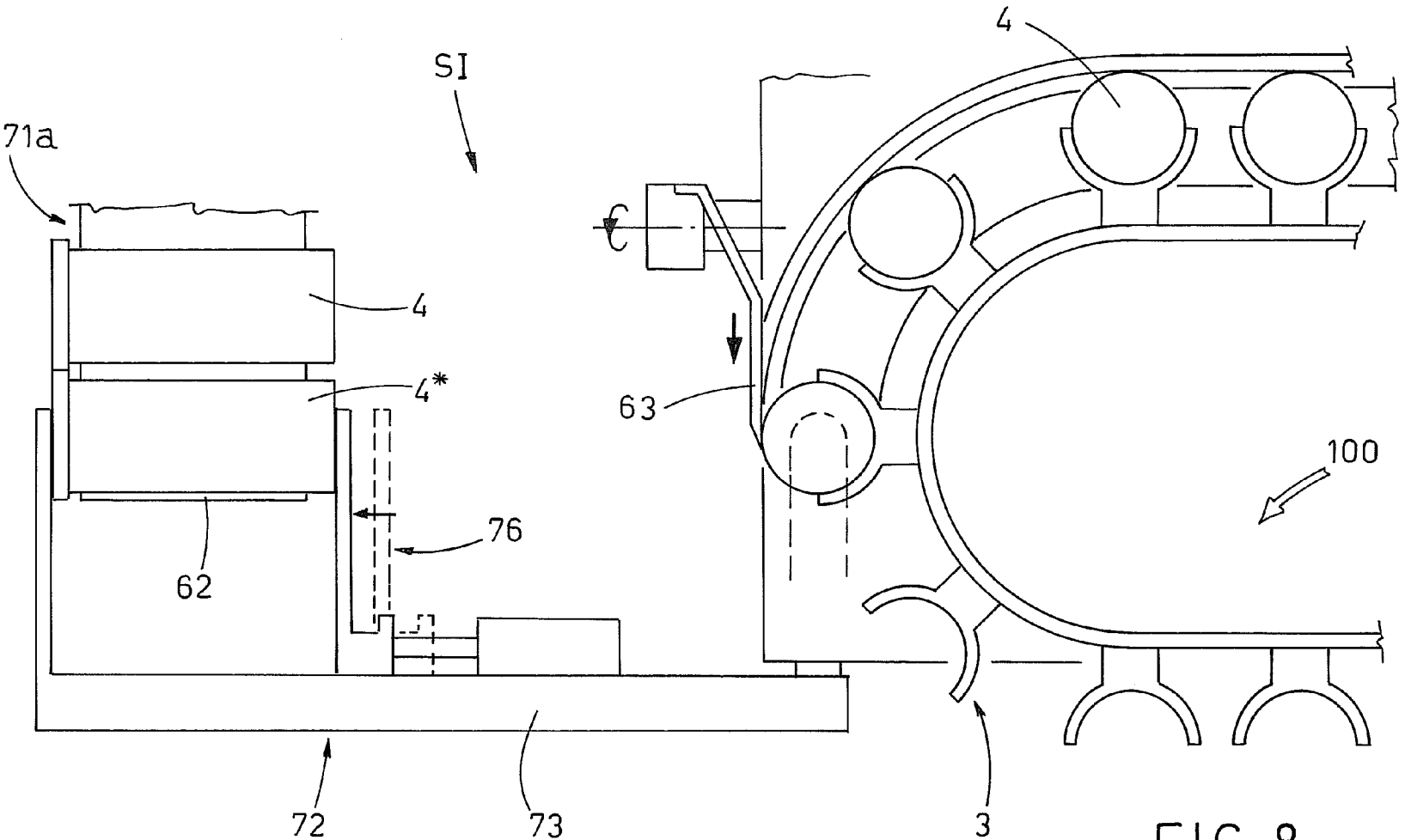
FIGS. 8, 9 schematically represent a plan view and a side view of organs operating at the interface station indicated in FIG. 7.

The first pick-up organs 72 operating in the inlet station SI have a first oscillating arm 73, activated synchronously with the multiple conveyor 100, and provided at the terminal end with pincers 76 which grasp the leading tube 4* present at the end section of the sloping channel 71*a* and release it, with its axis vertical and its mouth 4*a* facing upwards, to a corresponding paused gripping organ 3 of the multiple conveyor 100 (FIG. 8).

Near the paused gripping organ 3 there is a stabilizing wall 63 which is activated synchronously with the first oscillating arm 73 in such a way as to ensure that the leading tube 4* released by the oscillating arm 73 is retained.

Figure 9:
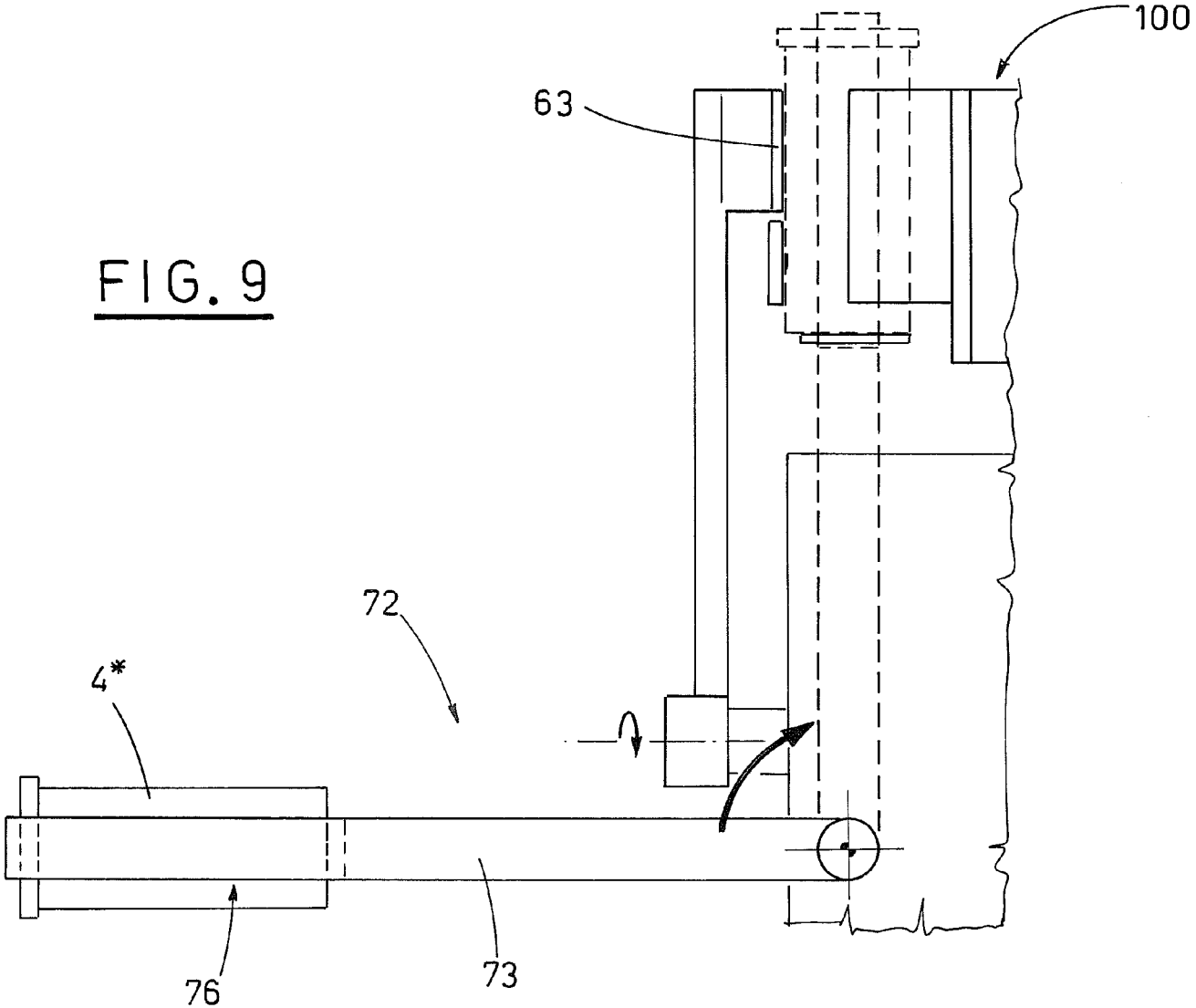

The wall 63 is borne on the end of a stem which is pivoted with its axis perpendicular to the axis of rotation of the first oscillating arm 73 (FIG. 9).

Figure 10:
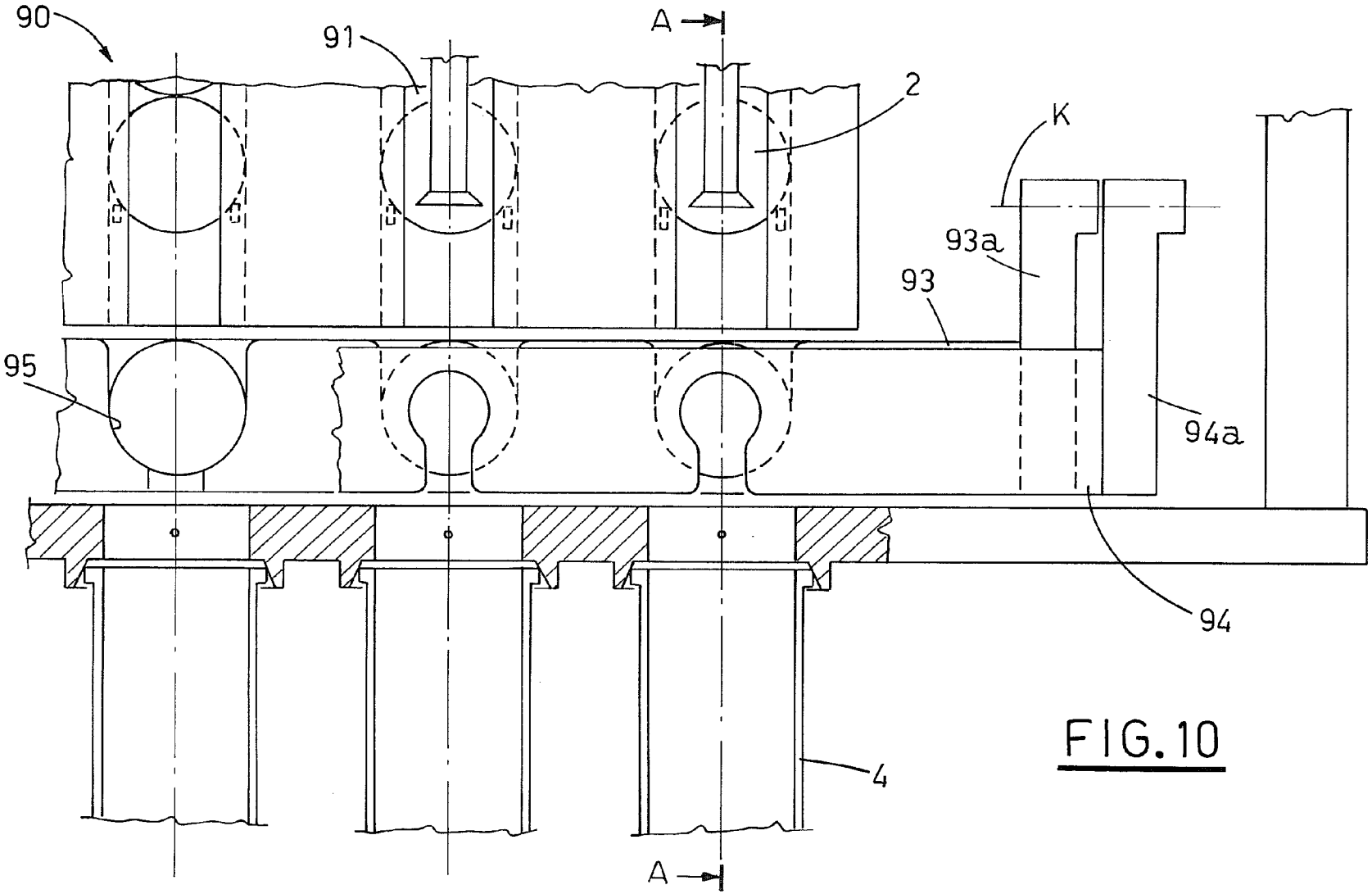
FIG. 10 schematically shows, in enlarged scale compared to FIGS. 1, 2, a side view of the filling station of the machine of the invention.
Figure 11:
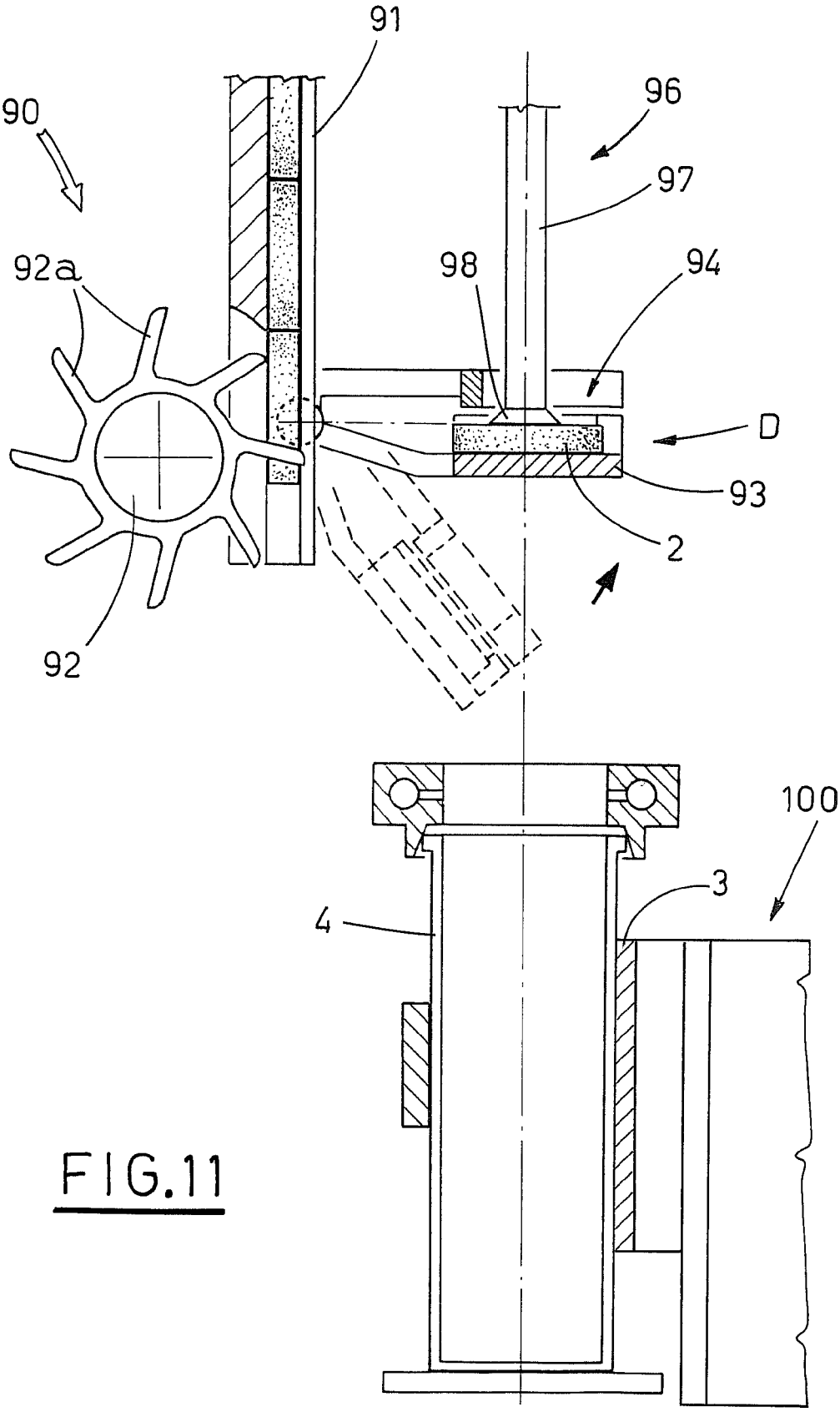
FIGS. 11, 12 each show a view along the section A-A shown in FIG. 10 in successive operational stages.
Figure 12:
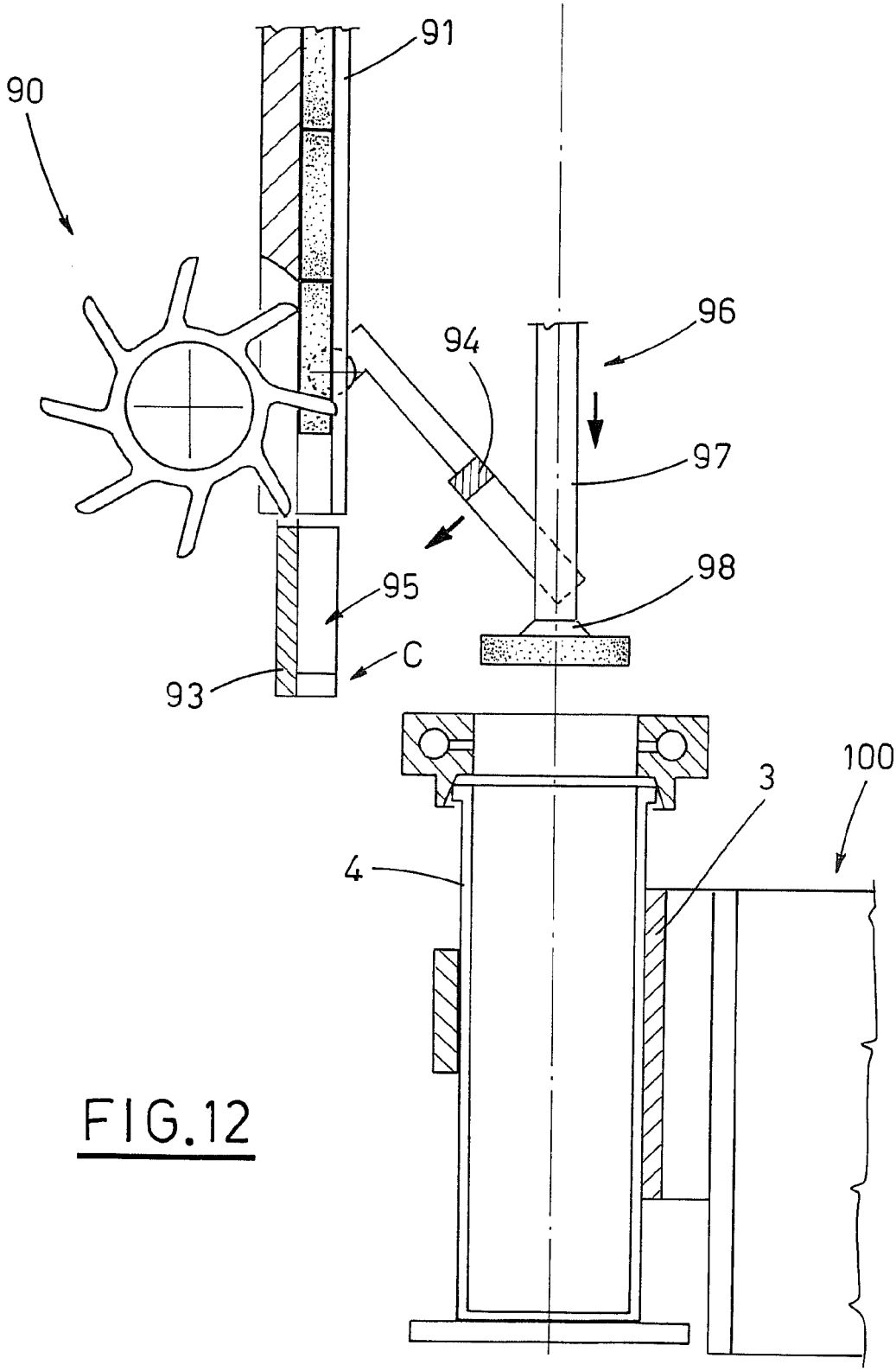
Figure 15A:
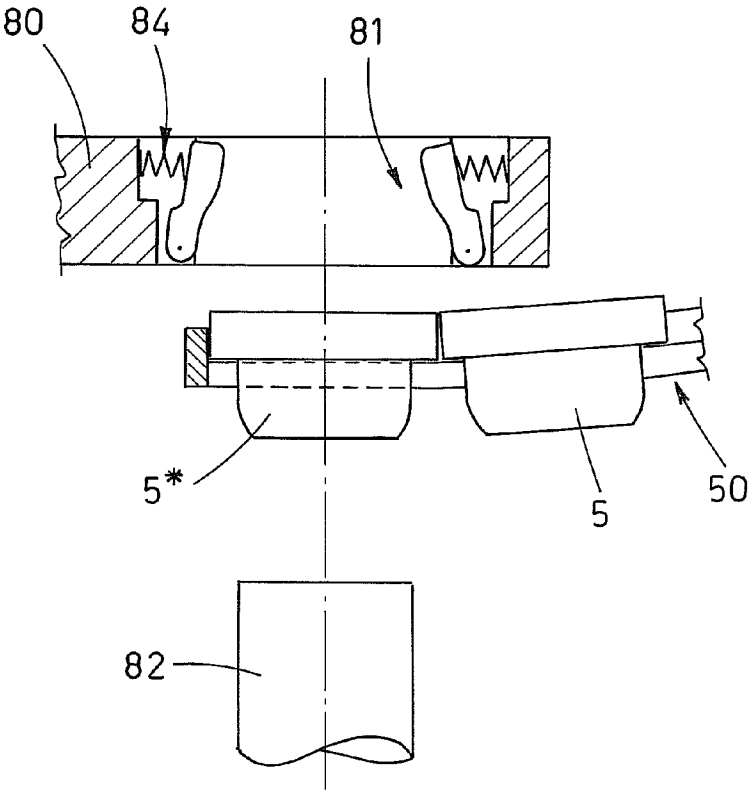
FIGS. 15A, 15B, 16 shows three views along an axial section of a filled container during successive operating stages at the capping station.
Figure 13:
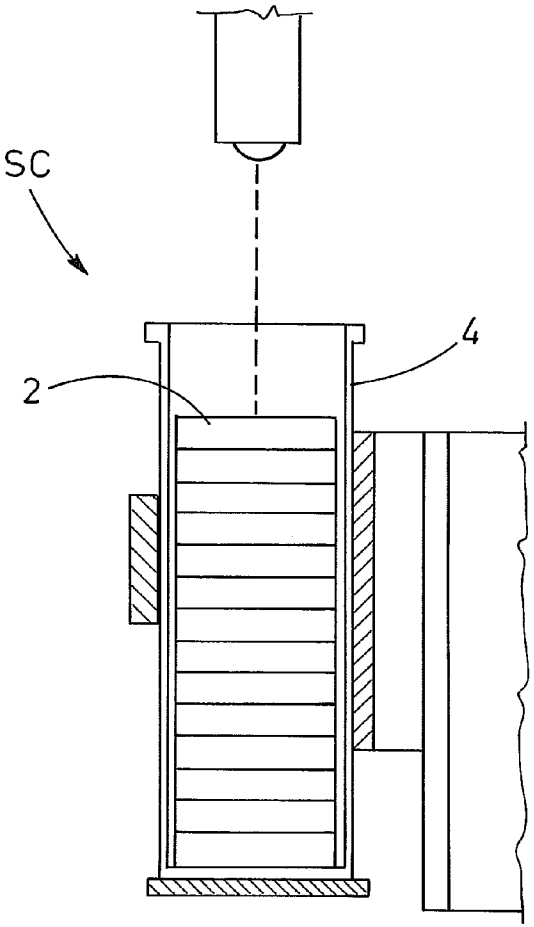
FIG. 13 shows a view along an axial section of a filled container at a station for controlling the articles contained.

With particular reference to FIGS. 10, 11, 12, the reference number 90 refers to a generic supply unit operating at the filling station SR and releasing tablets 2 intermittently in a vertical direction.

In the filling station SR a plurality of supply units 90 operate, arranged side by side and preferably activated synchronously, and preferably made as set out in document EP 06122475.4 in the name of the same Applicant (FIG. 10).

On the basis of this document each unit 90 comprises a channel 91 with vertical axis, along which tablets 2 are gravity-fed in a line, and a radial element 92 interacting with the tablets 2 fed along the channel 91, which radial element 92 is activated stepwise to release one tablet 2 at a time from the channel 91.

The axis of the radial element 92 is arranged perpendicularly to that of the associated channel 91; the radial element 92 is provided with a plurality of radially extending needle-like elements 92*a* each provided with a pair of spaced needles (not shown in the figures), which are in turn destined to retain a corresponding tablet 2 and support the tablets situated above.

In accordance with the Applicant's own application for an Italian patent no. BO2006A000899, two shaped elements are provided, a first shaped element 93 and a second shaped element 94, which extend for the whole length of the side of the supply unit 90 and are borne on the ends thereof by respective activating arms 93*a*, 94*a* (FIG. 10).

They are hinged at a shared horizontal axis K and activated by actuator organs, not illustrated for the sake of simplicity, which drive the shaped elements (93, 94) between a loading region C, situated near the outlet sections of the supply unit 90, within which the shaped elements (93, 94) are arranged close to each other and oriented vertically in such a way as to identify corresponding seatings 95 for receiving and retaining tablets released by the supply units 90; and a disengaging region D (FIG. 11), where the shaped elements (93, 94) are oriented horizontally, in a configuration perpendicular to the configuration assumed in the loading region C, with the first element 93 lower than the second element 94.

The tubes 4 at rest in the filling station SR are filled by means of a plurality of aspiration units 96 (the same number as the supply units 90) each comprising a tubular element 97 connected to a source of depression and terminating with a sucker element 98.

The aspiration units 96 are activated in a vertical direction synchronously with the activation of the elements 93, 94, between a picking up position of the tablets 2 borne by the elements 93, 94 and a position of release into the tubes 4.

In FIGS. 14, 15A, 15B, 16, the means operating in the closing station ST comprise a rotating carousel 80, activated synchronously with the multiple conveyor 100, and provided peripherally with a plurality of through-seatings 81, each of which can priorly face the end section of the supply line 50 of the caps 5 to receive the leading cap 5* via the action of pusher means 82, and subsequently coaxially face the mouth 4*a* of a paused filled container 4, to allow insertion therein of the retained cap 5* by action of extractor means 83.

Each through-seating 81 is advantageously provided with elastic means 84 which allow the caps 5 to be stably retained.

Figure 14:
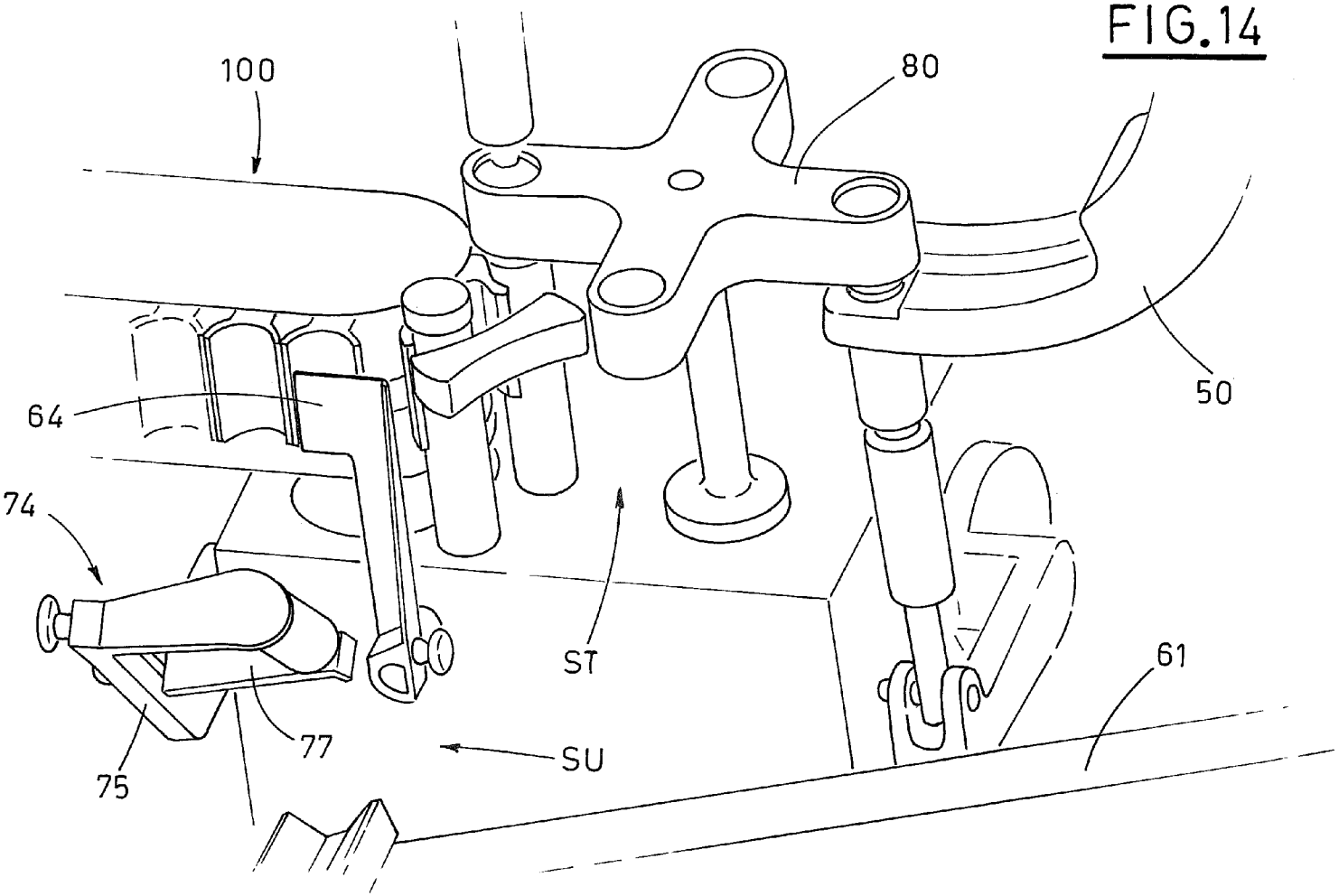
FIG. 14 shows schematically, in enlarged scale with respect to FIGS. 1, 2, a perspective view of the capping station of the machine of the invention.
Figure 15B:
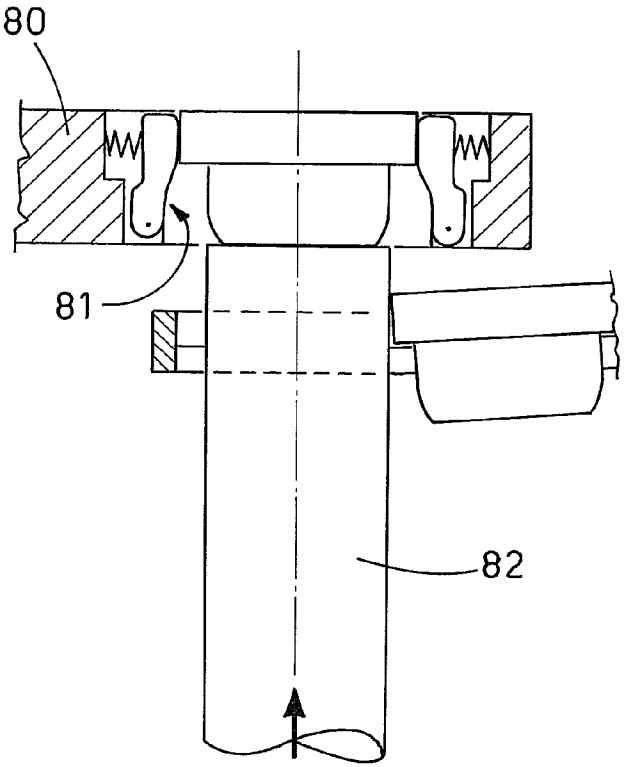
Figure 16:
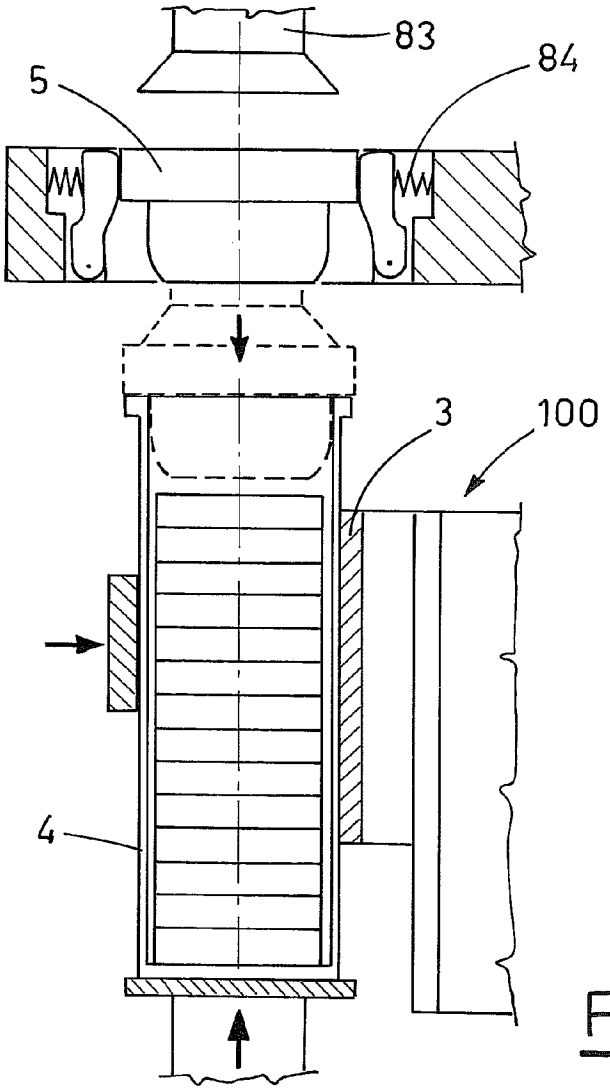

The second pick-up organs 72 operating in the outlet station SU have a second oscillating arm 75, activated synchronously with the multiple conveyor 100, provided at an end thereof with pincers 77 which grasp the closed container 4 borne by the gripping organ 3 and release the container 4 onto the transporter organs 61 (FIG. 14).

The second oscillating arm 75 tips the closed containers 4 picked up from the multiple conveyor sideways, releasing them onto the transporter organs 61 with axes thereof horizontally disposed.

A stabilizing wall 64 is located in proximity of the paused gripping organ 3, which stabilizing wall 64 is activated synchronously with the second oscillating arm 75 in such a way as to enable the paused filled container 4 to be retained prior to its picking up by the oscillating arm 75.

The wall 64 is borne at the end of a stem which is hinged with the axis thereof perpendicular to the axis of rotation of the second oscillating arm 75.

In a further embodiment of the machine 1, downstream of the inlet station SI a station SP is consecutively arranged, which station SP contains means for enabling internal cleaning of the cylindrical containers 4 borne by the gripping organs 3, and in which an orientating station SO is located containing means for adjusting the angular orientation of the cylindrical containers 4 borne by the gripping organs 3, so that an identification code can be read off (FIGS. 17, 18A, 18B, 18C).

These stations, the cleaning station SP, and the orientating station SO, are provided near the inlet curved section TI of the multiple conveyor 100, immediately downstream of the inlet station SI.

In this case, the multiple conveyor 100 can allow the temporal positioning of two consecutive batteries relative to the one transporter 10 and the other transporter 20, thus enabling the uninterrupted and intermittent presence of the gripping organs 3 both at the inlet station SI, and at the cleaning station SP and the orientating station SO.

The machine of the invention 1 is also provided with a control station SC, interposed between the filling station SR and the closing station ST, in which operate means for controlling the level of the stacks of tablets 2 contained in the cylindrical tubes 4.

The control station SC is provided near the outlet curved section TU of the multiple conveyor 100, immediately upstream of the closing station ST.

Also in this case the multiple conveyor 100 allows the temporal positioning of two consecutive batteries relative to the one transporter 10 and the other transporter 20, resulting in uninterrupted and intermittent presence at the control station SC, closing station ST and outlet station SU of the gripping organs 3 to which the filled containers 4 are associated.

Downstream of the outlet station SU, the machine 1 of the invention comprises a further station SS, in which means operate for rejecting filled containers 4 found to be defective, which therefore proceed without being discharged from the multiple conveyor 100.

The station SS is provided along the straight return section RR of the multiple conveyor 100, immediately downstream of the outlet station SU.

The above description explains how the machine for packing stacks of disc-shaped articles, tablets in particular, into rigid containers, tubes in particular, adapts the advancement cycle of the containers according to the optimum conditions for each operating station of the machine, in such a way as to ensure high productivity, delivering at the same time maximum simplicity of construction for the operating organs in each station.

Fundamentally, the machine is of the "step" type and has been designed so that the organs operating at the inlet, capping and outlet stations (and at any supplementary cleaning, orientation, control and rejection stations) act on one container at a time, for reasons of simplicity of construction, reliability and cost.

In contrast the organs operating at the filling station, which insert stacks of disc-shaped articles into the rigid containers, operate contemporaneously on a plurality of containers, in such a way that the prolonged rest time necessary to complete the filling affects a plurality of containers, thus augmenting the machine's productivity.

In consideration of the performance provided, the machine of the invention is distinguished by relatively low cost, since its organs are simple in conception, and it enables optimum levels of reliability and versatility to be obtained under all operating conditions.

The machine is characterized by layout configurations which satisfy the demanding requirements of ergonomics, size limitation and spatial arrangement of the various operating organs.

Obviously the invention has been described, with reference to the appended drawings, purely by way of non-limiting example: it is therefore evident that any modifications or variations brought to the invention are comprised within the ambit of the following claims.

What is claimed:

1. A machine for packing stacks of disc-shaped articles in rigid cylindrical containers, wherein the machine comprises:

a line which supplies empty cylindrical containers to an inlet station containing organs which release the empty containers, arranged with axes vertical and with mouths facing upwards, to corresponding gripping organs provided on a multiple conveyor;

a filling station, provided downstream of the inlet station, which contains a plurality of supply units which release a predetermined quantity of stacked disc-shaped articles into a plurality of cylindrical containers in a paused state, which plurality of cylindrical containers are borne by the multiple conveyor;

a closing station, located downstream of the filling station, containing means which pick up caps coming from a supply line and insert the caps into the mouths of the filled containers borne by the multiple conveyor, thus closing the containers;

an outlet station, provided downstream of the closing station, containing second organs which pick up paused individual closed containers borne by the multiple conveyor and release the containers to transporter organs;

and further wherein the multiple conveyor comprises:

at least an upper transporter and a lower transporter, which extend one above the other along a same ring-wound trajectory, to each of which at least two batteries of gripping organs are associated, at a same distance from one another, the at least two batteries associated to the upper transporter being intercalated with the corresponding at least two batteries associated to the lower transporter defining a number of empty places between the at least two consecutive batteries of the upper transporter and of the lower transporter, which number of empty places is dynamically variable from zero to a maximum value;

motor organs which independently activate the upper transporter and the lower transporter, resulting in an uninterrupted and intermittent presence of gripping organs at the inlet station, and of gripping organs associated to a relative container at the closing station and the outlet station and resulting in keeping the battery situated immediately downstream of the inlet station paused in the filling station, such as to avoid interference between the containers paused in the filling station and the empty containers associated to the gripping organs situated upstream of the filling station, which empty containers are intermittently-activated.

2. The machine of claim 1, wherein the line supplies empty cylindrical containers arranged with axes vertical and mouths facing upwards to the inlet station; deflector organs operating at the inlet station for tipping the cylindrical containers on sides thereof, and first picking up organs picking up individual overturned containers and releasing the containers, with axes vertically-disposed and mouths facing upwards, to the gripping organs provided by the multiple conveyor.

3. The machine of claim 2, wherein the deflector organs tip the containers onto a side thereof, the axes of the containers being placed in a substantially horizontal position.

4. The machine of claim 2, wherein the deflector organs operating at the inlet station comprise at least one inclined channel provided with a bottom and at least one side wall, enabling guided tipping of the containers on their sides, an end section of a channel being at a lower level than the initial section thereof and cooperating with means for abutment of the leading container of a row of containers contained therein.

5. The machine of claim 4, wherein the first picking up organs operating at the inlet station comprise a first oscillating arm, activated synchronously with the multiple conveyor, and having pincers provided at an end thereof which grasp the leading container present at the end section of the inclined channel and release the leading container to a corresponding paused gripping organ of the multiple conveyor.

6. The machine of claim 5, wherein near the paused gripping organ the machine comprises a rotating stabilizing wall, activated synchronously with the first oscillating arm such as to ensure that the leading container released by the oscillating arm is retained.

7. The machine of claim 1, wherein the motor organs which independently activate each transporter comprise an electronically-controlled motor, which activates corresponding transmission organs.

8. The machine of claim 7, wherein for each transporter, the transmission organs comprise a cogged belt, to which the batteries of gripping organs are associated and which is ring-wound on a drive pulley and a driven pulley.

9. The machine of claim 8, wherein the drive pulley and the driven pulley of each transporter are coaxial to one another.

10. The machine of claim 9, wherein the ring-wound trajectory identified by the transporters defines: a straight outgoing branch, a straight return branch, connected at ends thereof by curved sections, the curved sections being an inlet curved section and an outlet curved section, located at the respective drive pulley and driven pulley.

11. The machine of claim 8, wherein the ring-wound trajectory identified by the transporters defines: a straight outgoing branch, a straight return branch, connected at ends thereof by curved sections, the curved sections being an inlet curved section and an outlet curved section, located at the respective drive pulley and driven pulley.

12. The machine of claim 11, wherein the inlet station is positioned in the inlet curved section, the filling station is arranged along the outgoing branch, the closing station is positioned in the outlet curved section, and the outlet station is interposed between the end section of the outlet curved section and the initial section of the return branch.

13. The machine of claim 1, wherein the means contained in the closing station comprise a rotating carousel, activated synchronously with the multiple conveyor, and provided peripherally with a plurality of through-seatings of which each can priorly face the end section of the supply line of the caps in order to receive the leading cap by action of pusher means, and subsequently coaxially face the mouth of a paused filled container, thus allowing insertion of the retained cap into the mouth by action of extractor means; each through-seating being provided with elastic means for stably retaining the caps.

14. The machine of claim 1, further comprising second picking up organs operating in the outlet station, the second picking up organs comprising a second oscillating arm, activated synchronously with the multiple conveyor, and having pincers provided at an end thereof, which pincers grasp the closed container borne by the paused gripping organ and release the closed container onto the transporter organs.

15. The machine of claim 14, wherein the second oscillating arm picks up the closed container and releases the closed container onto the transporter organs after having tipped the container onto a side thereof.

16. The machine of claim 15, wherein the closed container is released to the transporter organs with the axis thereof substantially horizontal.

17. The machine of claim 14, wherein a stabilizing wall is located near the paused gripping organ, which stabilizing wall is activated synchronously with the second oscillating arm in such a way as to ensure retention of the paused filled container, prior to picking up thereof by the oscillating arm.

18. The machine of claim 1, wherein there is a supply line of cylindrical containers arranged perpendicular to the multiple conveyor.

19. The machine of claim 1, wherein the transporter organs cooperating with the outlet station are arranged parallel to the multiple conveyor.

20. The machine of claim 1, wherein downstream of the inlet station, the following are arranged consecutively: a station, containing means for internally cleaning the cylindrical containers borne by the gripping organs; a station containing means for adjusting the angular orientation of the cylindrical containers borne by the gripping organs, thus enabling a relative identification code to be read; the multiple conveyor allowing temporal positioning of two consecutive batteries relative to the upper transporter and the lower transporter, thus enabling uninterrupted and intermittent presence of the gripping organs at the inlet station, the cleaning station and the orientation station.

21. The machine of claim 1, wherein a station is interposed between the filling station and the closing station, containing means for controlling a level of the stacks of articles contained in the cylindrical containers; the multiple conveyor enabling temporal positioning of two consecutive batteries of the upper transporter and the lower transporter thus enabling uninterrupted and intermittent presence of the gripping organs, to which the filled containers are associated, at the control station, the closing station and the outlet station.

22. The machine of claim 1, wherein a station is provided downstream of the outlet station, which station contains means for rejecting filled containers deemed defective, which defective containers transit without being discharged from the multiple conveyor.

* * * * *